United States Patent [19]

Tietz

[11] Patent Number: 4,608,842

[45] Date of Patent: Sep. 2, 1986

[54] LOCK AND KEY SYSTEM

[75] Inventor: Werner Tietz, Berlin, Fed. Rep. of Germany

[73] Assignee: Zeiss Ikon AG, Fed. Rep. of Germany

[21] Appl. No.: 623,925

[22] Filed: Jun. 25, 1984

[51] Int. Cl.[4] ..... E05B 27/06

[52] U.S. Cl. ..... 70/358; 70/364 A; 70/378; 70/409; 70/419

[58] Field of Search ..... 70/358, 364 A, 378, 70/409, 419, 421, 416

[56] References Cited

U.S. PATENT DOCUMENTS 3,348,392 10/1967 Schreiber ..... 70/358
3,742,744 7/1973 Lumme ..... 70/358

FOREIGN PATENT DOCUMENTS 2,411,362 9/1975 Fed. Rep. of Germany ..... 70/358
2910886 10/1980 Fed. Rep. of Germany ..... 70/409

*Primary Examiner*—Robert L. Wolfe

*Attorney, Agent, or Firm*—Hill, Van Santen, Steadman & Simpson

[57] ABSTRACT

A lock and key system is provided wherein the flat sides of the keys are equipped with locking ribs projecting beyond the normal profile and provided with indentations (depressions) over their course, i.e., are equipped with height-modulated locking ribs. In order to achieve an additional scope of variation which adds to the variations presently available in locked key systems, based on locks having identical bore patterns, the auxiliary locking ribs of the keys of the individual locks are provided with a differing distribution of elevations and depressions and, interacting with these locking rib designs are a number of species of sensing pins. A first species of pins serve to sense elevations, a second species of pins serve to sense depressions and a third species of pins is provided at those locations of the locks at which the individual key comprises an elevation, but the superordinated or master key for the actuation of locks combined into a system comprises a rib depression at the same location.

6 Claims, 7 Drawing Figures

LOCK AND KEY SYSTEM

BACKGROUND OF THE INVENTION

1. Field of the Invention

The invention relates to lock and key systems and more specficially lock and key systems wherein the flat sides of the keys are equipped with locking ribs that project beyond the normal profile and are provided over their course with indentations.

2. Description of the Prior Art

Lock and key systems comprising flat keys having locking ribs on the flat sides of the keys have been disclosed by the German Letters Patent 2,411,362. Sensing pins are provided for the controlled sensing of the elevations and depressions of the locking ribs, a recess in the housing being associated with each sensing pin for the purpose of providing longitudinal movement of the pin when rib elevations pass as the key is introduced.

SUMMARY OF THE INVENTION

An object of the invention is to increase the possibilities of variations or permutations in lock and key systems, particularly in conjunction with the establishment of systems.

The invention, which has particular utility in locks having identical bore patterns, provides that the auxiliary locking ribs of the keys for the individual locks are equipped with a different distribution of elevations and depressions and that a number of different species of sensing elements or sensing pins are provided to interact with these locking rib designs.

A development of the fundamental idea which is essential to the invention provides pins for sensing the rib elevations, pins for sensing the rib depressions and, particularly in conjunction with the establishment of systems, pins for the actuation of the system locks by means of superordinated keys.

A further feature of the invention provides that the sensing pins for the elevations and depressions of the ribs are fabricated with a reduced thickness projection at their ends facing the key channel, whereas the pins serving the purpose of actuating the system locks by means of superordinated keys have the same thickness throughout and that all pin supporting bores appertaining thereto are inwardly graduated with shoulders permitting passage of only the reduced thickness projections.

It lies within the framework of the invention, finally, that through housing grooves are allocated to the sensing pins, the housing grooves assuring longitudinal movement of the pins for sensing the rib depressions, whose positionings vary from lock to lock, during the passage of rib elevations as the key is inserted.

BRIEF DESCRIPTION OF THE DRAWINGS

The invention shall be explained in greater detail with reference to FIGS. 1 through 5 wherein exemplary embodiments are illustrated.

DESCRIPTION OF THE PREFERRED EMBODIMENTS

Figure 1:
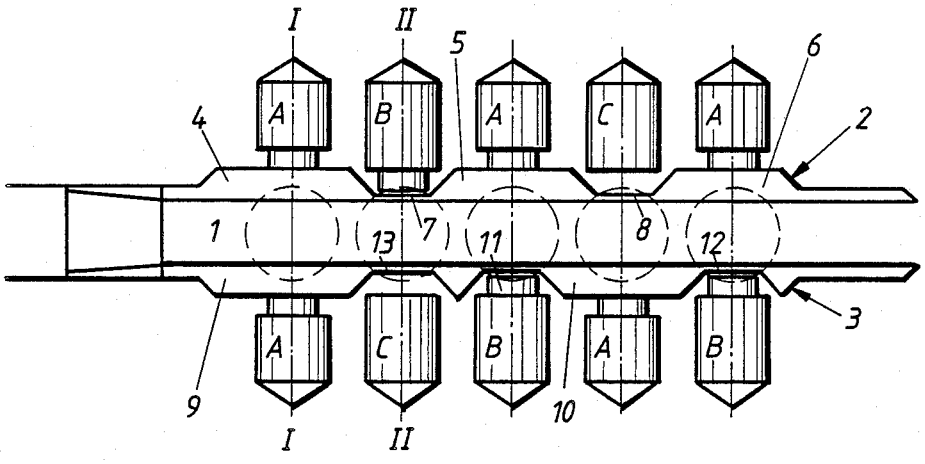
FIG. 1 shows a plan view of a horizontal longitudinal section of a key.

A key shank 1 shown in FIG. 1 comprises height-modulated locking ribs 2, 3 on both sides having elevations 4, 5, 6, 9, 10 sensed by pins of the species A and having depressions 7, 11 and 12 sensed by pins of the species B. As may be seen from FIG. 1, the pins of species B, which sense the depressions, require a greater length in order to align than do the pins of the species A, which sense the elevations. The pins of both species A and B are provided with reduced thickness projections at their ends facing the key channel and are carried in bearing bores 18 (FIGS. 2*a* and 2*b*) which have a stepped interior diameter. It is thus provided that the projections of the A and B pins can extend through the graduations or reduced diameter passages of the bores 18.

The depressions 8 and 13 are aligned with pins of the species C which ensure the manner of functioning of locks which are programmed for interaction with respective keys having different locking rib modulations and which allow these locks to be combined into a system. These pins of species C can also be referred to as filler pins. They are designed without reduced thickness projections, thus remain in front of the shoulders of the bearing bores 18 and guarantee that a "catching" of the cylinder core after initial rotation is avoided due to snap-in or re-entry of the spring-located housing pin (not shown) which lies in the same plane.

Figure 2A:
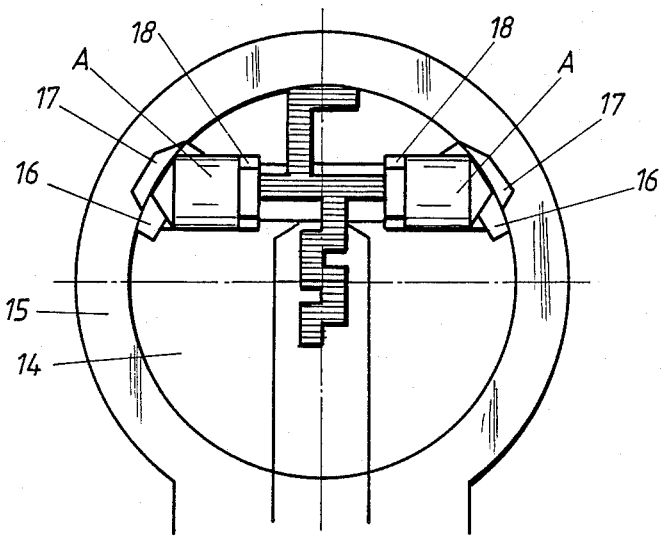
FIG. 2*a* shows a cross-section of lock and key taken generally along the line I—I of FIG. 1.
Figure 2B:
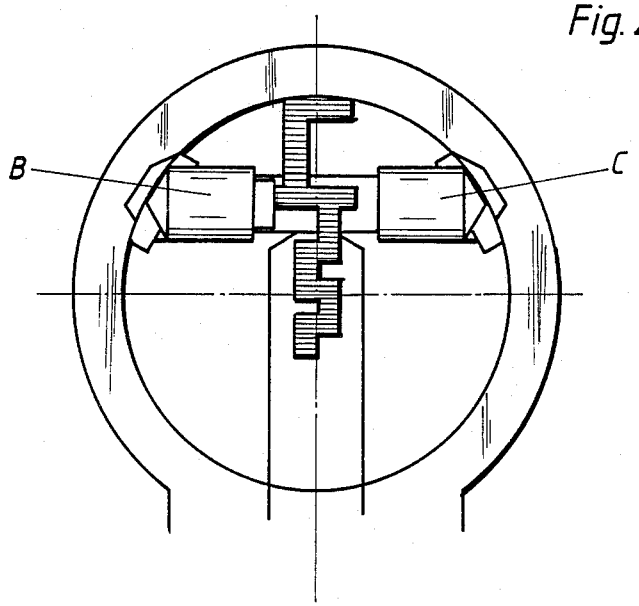
FIG. 2*b* shows a cross-section of lock and key taken generally along the line II—II of FIG. 1.

FIGS. 2*a* and 2*b* show views of the cross-sections along lines I—I and II—II of FIG. 1. They reveal the cylinder cor 14 in the housing 15, whereby the cylinder core 14 comprises stepped bores 18 in which the sensing pins are seated. Since locking rib elevations 4,9 of the introduced key 1 are shown sensed in FIG. 2*a*, pins of the species A are provided at these locations. Since, however, a depression 7 on the one side and a depression 13 given with the permutation are provided at the other side in the cross-section II—II of FIG. 2*b*, a B pin is allocated to the depression 7 and a C pin is allocated to the depression 13. The bearing bores 18 for the sensing pins terminate in counterbores 16. Housing recesses 17 which are expediently designed as longitudinal grooves extending through the housing are placed opposite the counterbores 16.

Figure 3:
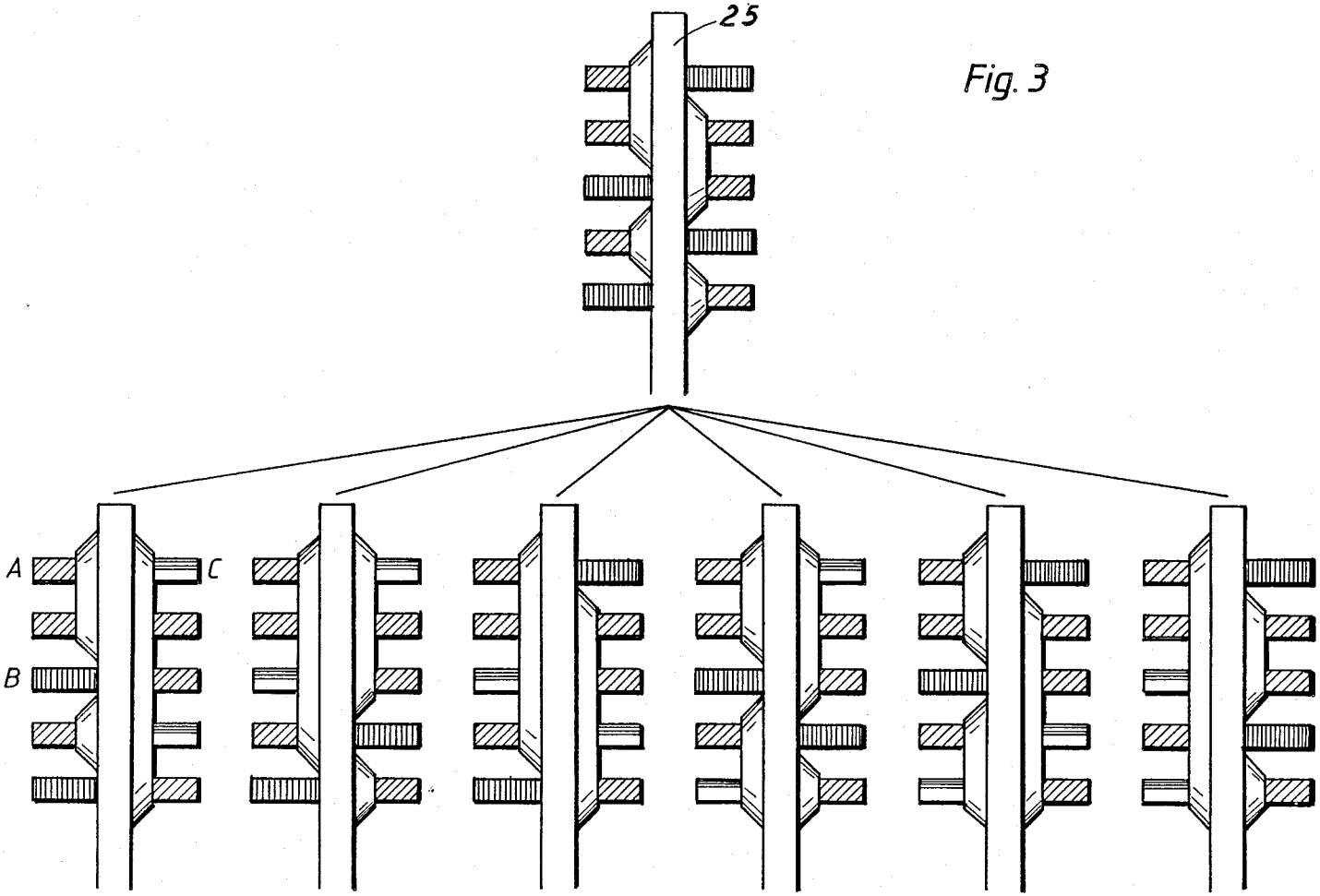
FIG. 3 is a diagramatic view of a lock and key system showing a master key and a plurality of subordinated locks which are actuatable by the master key.

In its lower part, FIG. 3 shows an exemplary number of individual locks which are equipped with sensing pins A, B and C such that they can be combined into a system that is actuatable by the superordinated key 25 shown thereabove. It can be seen that this is inventively effected in that filler pins C are provided at those locations of the individual locks at which rib elevations are sensed, these being offered as depressions in the superordinated or master key.

The pins C are in a position to align at these permutation locations without the housing pin positioned in the same plane being given an opportunity to enter in a blocking fashion. The fact that this is achieved by means of omitting the reduced thickness projection at the C pins, the shoulder preventing the entry of these pins into the graduation of the bearing bore, has already been indicated above.

The great advantage of the invention consists of having created an expansion of the number of lock variations effected by means of permutation of the height modulation of locking ribs which adds to the previously available variations so that it has become possible to significantly increase the number of individual locks secured against outside unlocking and the number of locks comprised in a system. Also to be emphasized is the simplicity of the arrangements leading to this successful concept as well as, in particular, that all locks are equipped with the identical bore patterns. Further, the invention can also be successfully realized at lock and key systems wherein the keys comprise more than one longitudinal locking rib per flat side.

Figure 4:
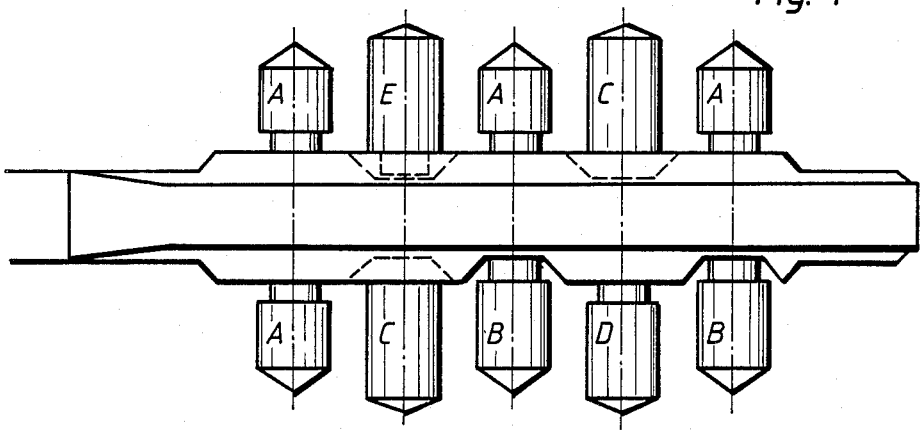
FIG. 4 is a plan view of an alternate embodiment of the key which uses four locking ribs.
Figure 5A:
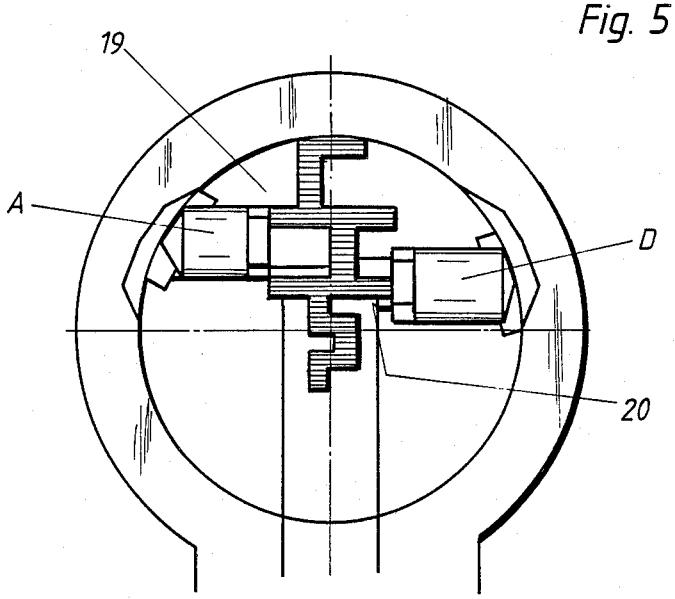
FIG. 5*a* is a cross-section through an alternate embodiment lock having four locking ribs.
Figure 5B:
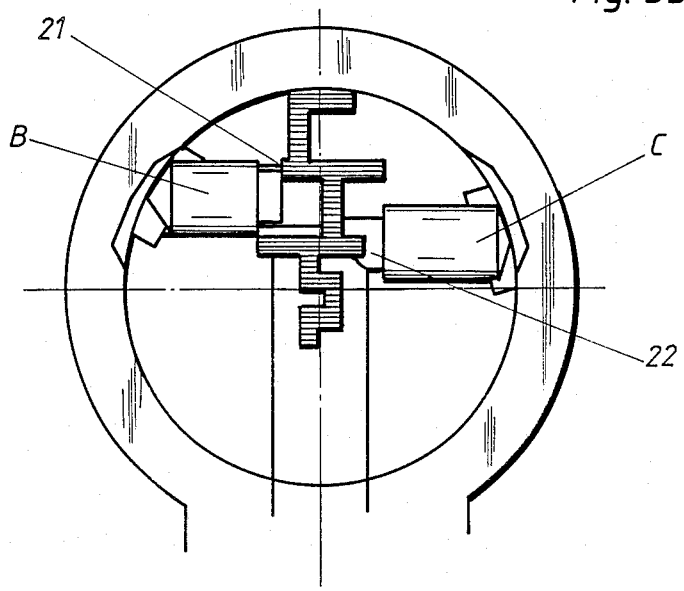
FIG. 5*b* is a cross-section through an alternate embodiment lock similar to the showing of FIG. 5*a*, showing different species of sensing pins.

FIGS. 4 and 5*a*, 5*b* show an exemplary embodiment for the sensing of a quadro-key, i.e., a key having four locking ribs, which serves to increase the degree of variation of a lock and key system embodying the invention. According thereto, the lefthand elevation 19 of the upper pair of locking ribs in FIG. 5*a* is sensed by a pin of the species A, whereas the right-hand elevation 20 of the lower pair of locking ribs is monitored by a pin D which functionally corresponds per se to a pin A but which, since it is placed more towards the center of the cylinder core than pin A, has a greater available length. The analogous case applies to the pin E as compared to pin B. Both pins A and D are provided with reduced thickness projections and, for purely spatial reasons, they are attached somewhat laterally displaced relative to the locking ribs with which they interact. As FIG. 4 shows, each rib side which is subject to sensing comprises a variation pin C which is here placed opposite a depression into which it cannot enter because of its omitted projection. As already presented in the preceding exemplary embodiments, these pins C guarantee that execution can be carried out within the framework of a permutation series with keys having locking ribs of a different design, that is, elevations instead of the depressions in the present case at those locations.

The lock and key combination illustrated in FIG. 5*b* shows a key which, in comparison to the key of FIG. 5*a*, comprises locking rib depressions of which the upper left 21 is sensed by a pin of the species B whereas the depression at the lower right 22 is opened by a pin of the species C. This key can be a superordinated key. It can exercise locking actions instead of a different key from the appertaining permutation series which must comprise an elevation at the location of the depression 22 shown here at the lower right.

As is apparent from the foregoing specification, the present invention is susceptible of being embodied with various alterations and modifications which may differ particularly from those that have been described in the preceeding specification and description. For this reason, it is to be fully understood that all of the foregoing is intended to be merely illustrative and is not to be construed or interpreted as being restrictive or otherwise limiting of the present invention, excepting as it is set forth and defined in the hereto appended claims.

I claim as my invention:

1. A lock and key system wherein an otherwise flat side of the key has at least one locking rib which projects beyond a normal key profile and is sensed with respect to elevations and depressions comprising:

a lock housing with a lock cylinder and a key channel having a plurality of identical transverse bores in said lock cylinder, a key insertable into said lock cylinder having at least one locking rib projecting from the normal profile of said key, said locking rib being comprised of elevations and depressions, a plurality of types of sensing elements carried in said transverse bores to interact with the elevations and depressions of said locking rib, a first type of sensing element being a cylindrical member with an end having a reduced diameter which projects into said key channel for sensing rib elevations, a second type of sensing element being a cylindrical member with an end having a reduced diameter which projects into said key channel for sensing rib depressions, a third type of sensing element being a cylindrical member without a reduced diameter projection, said transverse bores being provided with internal shoulders preventing excursion of said sensing elements past said shoulders, but allowing excursion of said projections past said shoulders into said key channel to engage said key rib, whereby said lock and key system has enhanced variation possibilities which allows actuation of an increased number of differently configured individual locks by a master key.

2. The system of claim 1 wherein said lock housing is provided with longitudinal housing grooves aligned with said bores for permitting movement of said sensing elements.

3. The system of claim 1 wherein said keys are provided with four locking ribs projecting from said normal profile of said key.

4. A system of locks wherein each individual lock is actuatable by its own discrete individual key and all locks in said system are actuatable by a master key comprising:

a plurality of locks having a housing, a lock cylinder and a key passage in said lock cylinder, said locks further having identical lateral bores in said lock cylinders extending into said key passage, a plurality of keys, each key having at least one locking rib projecting above an otherwise flat surface of said key and being aligned with said bores when said key is inserted into said key passage, said locking ribs on said various keys being provided with differing distributions of elevations and depressions such that each key is effective to actuate at least one of said locks, a first species of sensing element being a cylindrical member with an end having a reduced diameter which projects into said key passage for sensing rib elevations, a second species of sensing elements being a cylindrical member with an end having a reduced diameter which projects into said key passage for sensing rib depressions, a third species of sensing elements being a cylindrical member without a reduced diameter projection, said lateral bores each provided with a graduated interior diameter preventing said sensing elements from moving into said key passage, but allowing said reduced diameter projections to extend into said key channel, a plurality of species of sensing elements carried in said bores to interact with said elevations and depressions to determine if an inserted key is a correct key for actuating said lock, whereby said system of locks has enhanced variation possibilities allowing actuation of an increased number of differently configured individual locks by a master key.

5. The system of claim 4 wherein said lock housing is provided with longitudinal housing grooves aligned with said bores for permitting movement of said sensing elements.

6. The system of claim 4 wherein said keys are provided with four locking ribs projecting above said flat surface.

* * * * *